US006749451B2

(12) United States Patent
Schmitt

(10) Patent No.: US 6,749,451 B2
(45) Date of Patent: Jun. 15, 2004

(54) ELECTRICAL PLUG-IN ADAPTER FOR OPTIONAL CONNECTION TO DIFFERENT NATIONAL PLUG-IN SYSTEMS

(75) Inventor: Emil Schmitt, Mömbris (DE)

(73) Assignee: Heinrich Kopp AG, Mombris (DE)

( * ) Notice: Subject to any disclaimer, the term of this patent is extended or adjusted under 35 U.S.C. 154(b) by 0 days.

(21) Appl. No.: 10/140,461

(22) Filed: May 7, 2002

(65) Prior Publication Data

US 2002/0173187 A1 Nov. 21, 2002

(30) Foreign Application Priority Data

May 10, 2001 (DE) ..... 101 22 620

(51) Int. Cl.[7] ..... H01R 27/00; H01R 1/56; H01R 29/00

(52) U.S. Cl. ..... 439/218; 439/52; 439/53; 439/171

(58) Field of Search ..... 439/171, 172, 439/173, 174, 175, 518, 131, 221, 956, 218, 52, 53

(56) References Cited

U.S. PATENT DOCUMENTS 3,980,372 A * 9/1976 Ranzanigo ..... 439/139
4,909,749 A * 3/1990 Long ..... 439/263
6,419,504 B1 * 7/2002 Nelson ..... 439/103
6,520,787 B1 * 2/2003 Lott ..... 439/218

FOREIGN PATENT DOCUMENTS

| | | |
|---|---|---|
| DE | 3601 469 A1 | 7/1987 |
| DE | 692 00 988 T2 | 9/1992 |
| DE | 42 09 076 A1 | 9/1993 |
| DE | 692 06 998 T2 | 12/1995 |
| DE | 198 35 161 C1 | 10/1999 |
| DE | 198 45 962 C1 | 10/1999 |
| EP | 0 570 039 A1 | 11/1993 |

* cited by examiner

*Primary Examiner*—Chandrika Prasad
(74) *Attorney, Agent, or Firm*—Jenkins, Wilson & Taylor, P.A.

(57) ABSTRACT

A plug-in adapter for optional connection of a three (3) pin plug system to different nationally specific plugging systems both with and without grounding contact. The adapter comprises a housing with a polarity of different projecting plugging systems disposed thereon. A socket receptacle supported for rotation in the housing is provided and presents electrical contacts adapted to be connected in the respective rotational positions of the socket receptacle, which are associated with the outer plugging systems, with corresponding electrical contacts of the respective plugging systems. Further, at least one of the plugging systems comprises a grounding contact pin supported for movement in the housing.

14 Claims, 15 Drawing Sheets

Fig.9
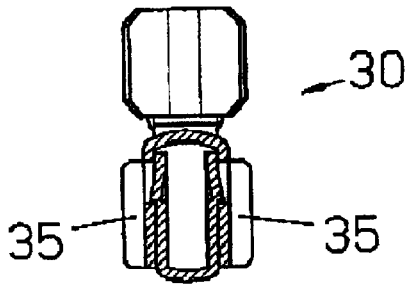
Fig.7
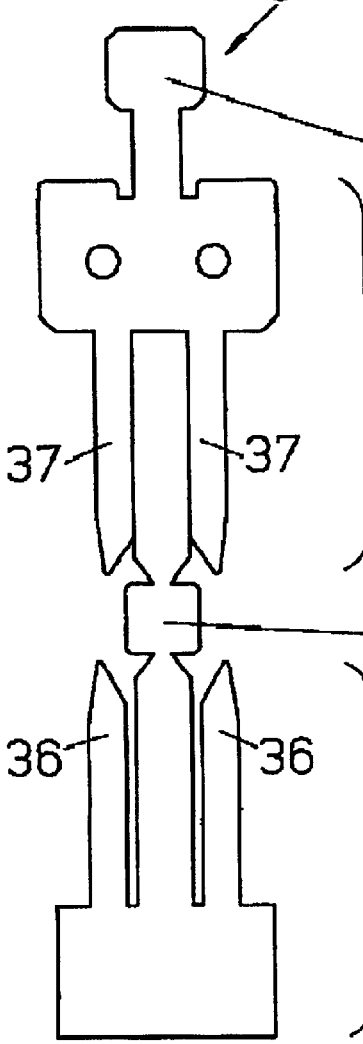
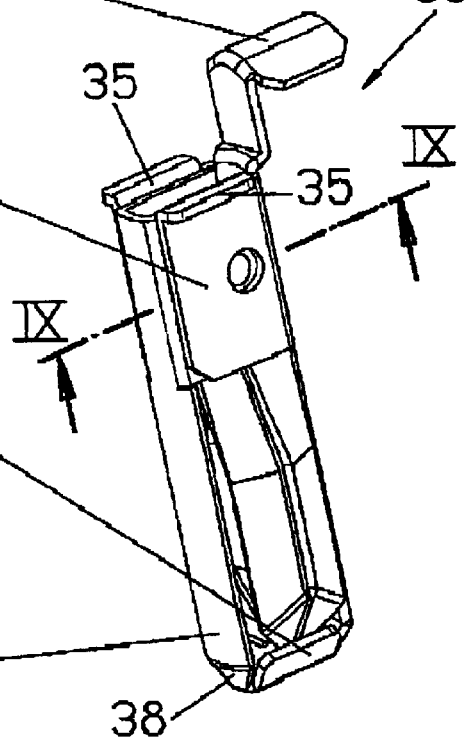
Fig.8

ELECTRICAL PLUG-IN ADAPTER FOR OPTIONAL CONNECTION TO DIFFERENT NATIONAL PLUG-IN SYSTEMS

TECHNICAL FIELD

The present invention relates to an electrical plug-in adapter for optional connection of a three-pin plug system with lateral grounding contacts to different nationally specific plugging systems with and without grounding contact in accordance with the introductory clause of Patent Claim 1.

BACKGROUND ART

Such an electrical plug-in adapter without a grounding contact is disclosed already in the German Patent DE 3601469. This known plug-in adapter is provided with a housing on whose outside periphery several plugging systems are disposed as well as with a socket receptacle supported for rotation in the housing and comprising electrical contacts that are adapted for connection to corresponding electrical of the respective plugging systems in rotational positions of the socket receptacle, which are each associated with the outside plugging systems. As this known plug-in adapter is designed only for two-pin plugs without grounding contact the application potential of the known plug-in adapter is limited in view of the great number of international systems.

The present invention is based on the problem of improving an electrical plug-in adapter of the general type outlined by way of introduction for the application with a comparatively larger number of plugging systems with and without grounding contact.

In accordance with the present invention this problem is solved with the features defined in Patent Claim 1. Preferred features for expedient improvements of the invention are defined in the dependent Patent Claims.

With the invention hence an electrical plug-in adapter is made available in which different national plugs are arranged on a polygonal housing whilst a standardised socket receptacle is inserted and supported for rotation in a central opening inside the housing. The socket receptacle is provided for a three-pin plugging system and presents, on its underside, resilient contact sockets for the two plug pins as well as a grounding contact bow, with all three contact elements being equipped with a resilient contact lug. The plug pins and grounding contacts, which are distributed along the periphery, are each provided with a contact area on their inner head end supported in the housing, which contact areas are distributed, in their turn, on two superimposed orbits on the periphery of the inner housing opening, with the two pole pins on the lower orbit and the grounding contact on the upper orbit being each disposed preferably in a uniform triangular relationship. By rotation on the adjustable socket receptacle, the three resilient contact lugs can be contacted with the three rigid contact areas of the plug pin array in a marked position on the respective desired plug so as to establish a direct plug-in connection of the three-pin plugging systems in the socket receptacle with a respectively different nationally specific plug-and-socket system. For safety reasons, the plug pins out of engagement remain electrically neutral while the socket receptacle seals or is locked in the respective socket position so as to ensure a stable and safe contact connection.

SUMMARY OF THE INVENTION

In accordance with the present invention, the functional principle of the two-pin plug in electrical appliances, which is known from the German Patent 3601469, is extended to sockets with grounding contact and two-pin plugs with the aim to accommodate a maximum number of different connection systems on the smallest adapter housing possible, with a combination of plugging systems expediently related to each other, such as the old British plugging system with round plug pins and the new system with rectangular pins.

Moreover, the Swiss and the Italian plugging system were expediently united to form a single-plug combination wherein a grounding contact pin, which is centrally disposed between the plug pins, is arranged for displacement so that the plug could be plugged in the respectively required position. Furthermore, it is expedient to combine the Home office plug with lateral grounding contacts with the central grounding contact in a manner known per se and standardised in compliance with CEE 7.

Another extension of the potential applications is provided insofar as an "America plug" and a combined Italian/Swiss plug are equipped with fold-down grounding contact pins so as to permit an adaptation to two-pin sockets without grounding contact. In this solution moreover expedient provisions are made to the effect that a respective locking lever, which is so connected to the fold-down grounding contact pin, is inevitably pivoted via the grounding contact bow into the catchment region of the socket receptacle, when it is pivoted, so as to prevent reliably an illicit operation of electrical appliances with grounding contact plug connection on two-pin sockets.

In correspondence with another embodiment of the invention, for improvement of safety, moreover provisions are made on the plugged-in plug adapter in order to close the two plug pin openings in the socket receptacle with a preferably automatically closing locking mechanism that releases the pin openings only in the positions associated with the respective plugging system in the case of plug pins of the same length and/or of an identical type. With this provision, a safe protection against accidental contact is expediently achieved and thus an unintentional or unauthorised insertion of metal objects is prevented.

According to the inventive concept, the number of the various potential applications of the electrical plug-in adapter is increased by the provision that at least one of the plugging systems comprises a grounding contact pin supported for movement in the housing. This grounding contact pin may preferably be supported for displacement and/or for pivoting in the housing and creates, by the various possible positions of the grounding contact pin, expedient new combinations of contact pins matching with individual nationally specific plugging systems.

In accordance with a preferred embodiment of the invention, the grounding contact pin is shaped from a punched folded brass sheet material with a hollow inside space and has a peripheral surface with rounded and resilient sections, with the respective rounded and the respective resilient sections opposition each other. In correspondence with a preferred embodiment, the condition of a punched board made of brass sheet material is differently shaped in isolated areas and then folded into its final shape. Here resilient sections are preferably formed to have flexible tongues that can be moved from a laterally projecting position for the insertion of the contact pin into a round contact opening in the case of insertion into a rectangular contact opening into a position in the inside space. With this provision, it is possible to insert the grounding contact pin into both round and rectangular grounding contact openings or sockets, respectively, and establish a safe contact.

According to another preferred embodiment of the invention, the folded contact pin made of brass sheet material presents at least one bent guiding section that is guided in the housing for displacement between two spaced stops. The plugging system with this aforementioned folded contact pin is particularly well suitable for the connection to both the old British plugging system with round plug pins as well as the new British plugging system with rectangular pins.

For connection of the plug-in adapter to the Swiss and Italian plugging systems a single plug system is provided on the plug-in adapter housing according to a preferred embodiment of the invention, which provides for one central displaceable grounding contact pin made of a solid profile.

In correspondence with a further embodiment of the invention, the grounding contact pin is provided on its rear end with a guiding profile while it is displaceable via lateral pins in the housing in a direction orthogonal on the remaining contact pins, whilst, by contrast, the guiding profile is prevented from pivoting and locked outside the uppermost displaced position of the grounding contact pin in the housing by a housing stop.

In correspondence with another embodiment of the invention, provisions are made to the effect that in the event of pivoting the grounding contact pin can activate a locking lever locking the socket receptacle against plugging of a plug. This provision expediently ensures that electrical appliances that must definitely not be operated other than with a grounding contact cannot be connected to a two-pin socket without grounding contact.

In correspondence with an alternative embodiment of the invention, the contact pin of the plugging system for the old British plugging system with round plug pins and the new British system with rectangular pins is not shaped from a punched folded brass sheer material with a hollow interior space but is rather manufactured of two separate parts, with a resilient element with resilient tongues being attached on the hollow contact pin body. This entails advantages for both manufacture and assembly as well as mounting.

According to a further alternative embodiment of the invention, a plugging system with two flat plugs and a U-shaped grounding contact pin can be converted into an American plugging system by pivoting the grounding contact pin, with a modified locking lever being provided that engages, in its locking position, into the socket receptacle and prevents a grounding contact pin from being inserted into the socket receptacle, while it is disposed, in its inoperative position, outside the socket receptacle. In correspondence with the alternative embodiment, this locking lever is moved out of its inoperative position into the locking position by a pushing and pivoting movement, with provisions being preferably made for locking the grounding contact pin from pivoting by means of the looking lever in its inoperative position. The locking lever preferably presents a pivoting shaft that is supported in the housing and provides for a stopping profile for a contact pin cam in the inoperative position.

According to another embodiment of the invention, the locking lever is adapted for being inserted into a recess in the housing on the side of the edge on the socket receptacle above the grounding contact. With this provision, the operation of electrical appliances with grounding contact on two-pole sockets is reliably prevented for safety reasons because the locking lever, in its locking position, covers the grounding contact in the socket receptacle, with the insertion of two-pole plugs without grounding contact being possible, however.

In the aforementioned alternative embodiment of the invention with a locking lever that can be moved by a pushing and pivoting movement out of its inoperative position into the locking position, the plugging system for the Swiss and Italian plugs is modified to the effect that the grounding contact pin is no longer pivotable but only displaceable still because now only one locking lever is still provided in combination with the American plugging system.

BRIEF DESCRIPTION OF THE DRAWINGS

For further details, features and advantages of the invention, reference is made to the description given below in which the invention will be explained in more details with reference to the annexed drawings wherein:

FIG. 7 a plan view of a board punched out of a brass sheet material for the production of the displaceable contact pin according to FIGS. 4 to 6;

FIG. 8 is a perspective isolated representation of a contact pin according to FIGS. 4 to 6 in the folded condition;

FIG. 9 shows a cut along the dot-and-dash line IX—IX in FIG. 8;

DETAILED DESCRIPTION OF THE INVENTION

Figure 1:
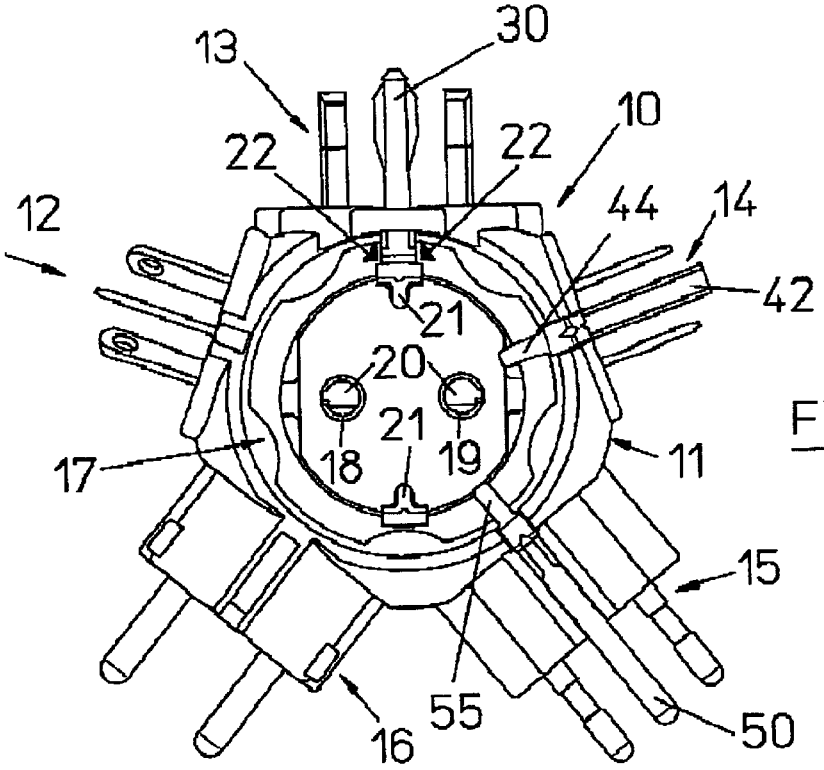
FIG. 1 is a plan view of an embodiment of an electrical plug-in adapter according to the present invention.
Figure 2:
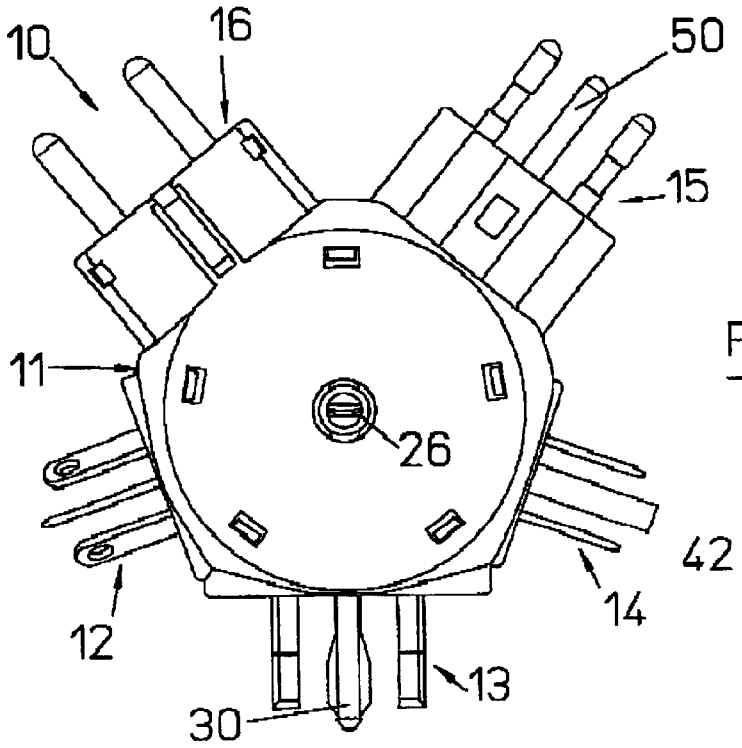
FIG. 2 is a view from below of the plug-in adapter according to FIG. 1.

FIG. 1 illustrates one embodiment of an inventive electrical plug-in adapter 10 that is provided for optional connection of a three-pin plug system to different nationally specific plugging systems with and without grounding contact.

The plug-in adapter 10 consists of a housing 11 on whose outer periphery several different plugging systems 12 to 16 are disposed to project on flattened housing sections. A socket receptacle 17 is supported centrally in the housing 11 for rotation. The socket receptacle 17 is provided with plug insertion openings 18 and 19 that are predominantly closed by a locking means 20, as will be explained below with reference to the FIGS. 19 and 20.

The reference numeral 21 roughly indicates grounding contacts. The socket receptacle 17 is provided for the insertion of a grounding contact plug and is capable of establishing an electrical connection with a corresponding plugging system by adjustment to one of the different plugging systems 12 to 16—in FIG. 1 with the plugging system 13, as is roughly indicated by the arrows 22. For locking of the adjusted position, the socket receptacle is adapted for locking or latching in the respective position associated with the individual plugging systems 12 to 16; as is evident with reference to FIG. 3, contact studs provided on the socket receptacle come into contact only with the respectively associated plug system whilst the remaining plug systems remain without electrical contact.

Figure 3:
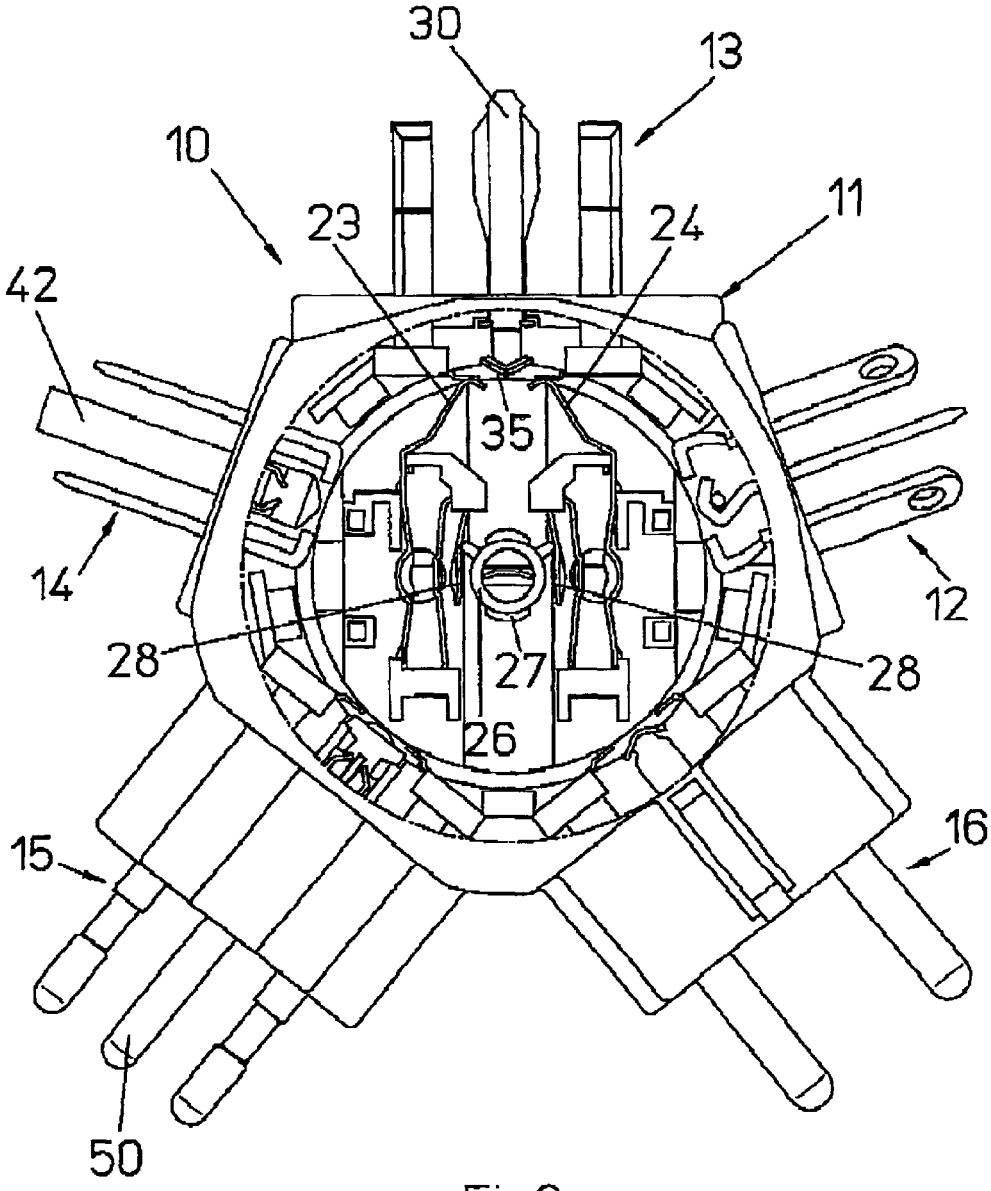
FIG. 3 is a plan view of the plug-in adapter according to FIG. 1, wherein the central region has been omitted so as to show the contact studs and the support of the socket receptacle more clearly.

In FIG. 3, the contact studs of the socket receptacle 17 are identified by the reference numerals 23 and 24 while the reference numeral 35 identifies the grounding contact. The arrangement is made herein such a way that the plugging systems 12 to 18 present contact studs complementary with the corresponding contact studs 23, 24, and 35. The socket receptacle 17 is adapted for rotation about a central pin 26 on the underside, which is equally provided with a locking profile 27 on the outside for respective association with the rotational positions for the individual plugging systems 12 to 16. The locking profile 27 is elastically loaded by mutually opposing flexible tongues 28 disposed on the socket receptacle 17.

Figure 4:
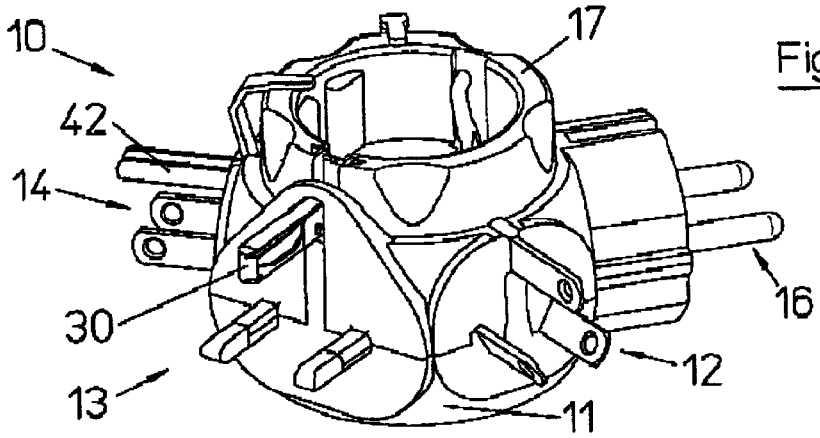
FIG. 4 is a perspective view of the plug-in adapter according to FIG. 1—in an oblique direction from the top left in FIG. 1, for clear representation of a plugging system that combines the old British plugging system with round plug pins and the new British system with rectangular pins.
Figure 5:
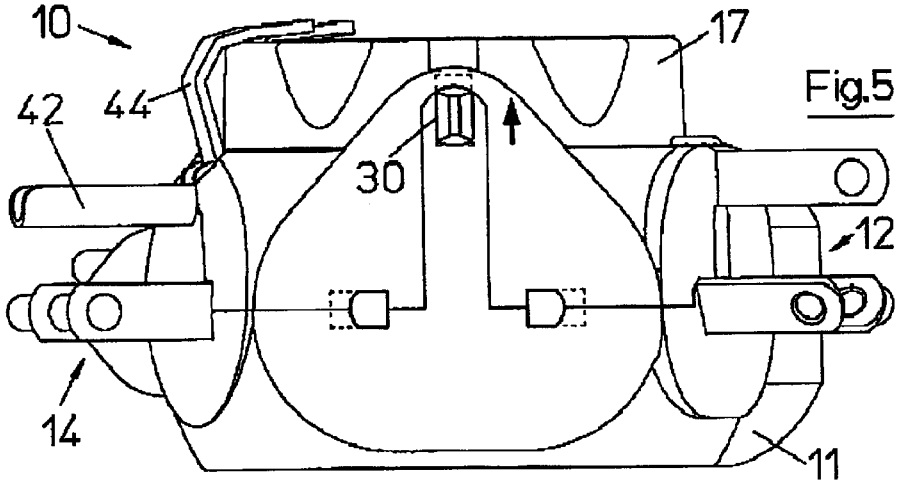
FIG. 5 is a plan view of the plug system according to FIG. 4 for illustration of the plug system matching with the new British plugging system with rectangular pins.
Figure 6:
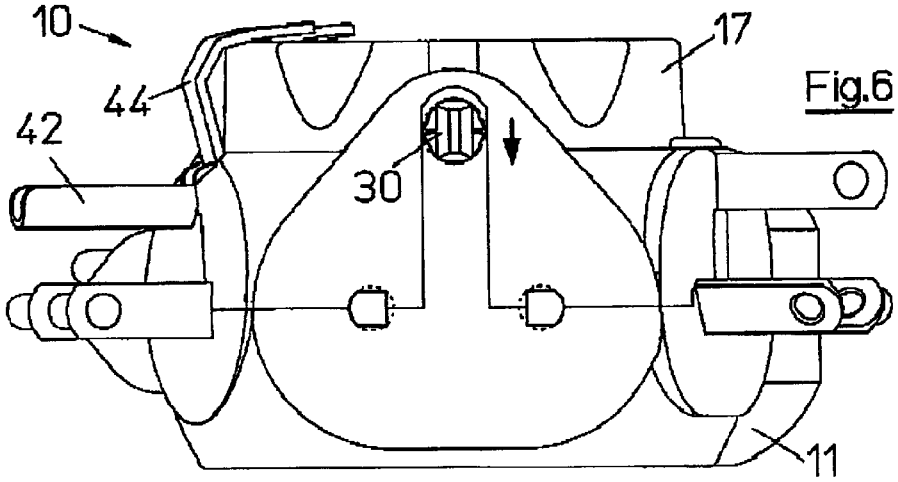
FIG. 6 is a view according to FIG. 5, which serves to illustrate how the plug system matches with the old British plugging system with round plug pins.

FIGS. 4 to 6 illustrate the plug system 13 in more details, which is suitable for the old British plugging system with round plug pins and the new British system with rectangular pins. FIG. 5 shows the plug system 13 with the three-dimensional association with the new British plugging system whilst FIG. 6 shows an association with the old British plugging system. What is important here is the vertical mobility of the grounding contact pin 30 and its outside shape design. The respective plug opening configurations according to the new and the old British system is roughly indicated by dotted lines in FIGS. 5 and 6.

FIGS. 7 to 9 illustrate the structure of the grounding contact pin 30 in more details. According to FIG. 7, the grounding contact pin 30 consists of a punched board made of brass sheet material, which can be subdivided into subsections 31 to 34. The grounding contact pin is differently shaped in isolated regions from the flat board shown in FIG. 7, ands then it is folded into its actual final shape proper that is illustrated in FIG. 8. To this end, the region 31 is given a V-shaped profile and forms the area of contact with the sliding contact or sliding contact bow 25 in the housing 11 of the plug-in adapter 10, as is roughly indicated in FIG. 3.

The regions 32 and 34 are given a U-shaped profile while their widths are so determined that the outside dimension of the first U-profile equals the inside dimension of the other U-profile. Here, the rear end of the larger U-profile (region 32) projects on both sides by roughly 2 mm, with the projection being bent at a right angle to the outside (35) and serving for support or movable guidance in the housing 11 of the plug-in adapter 10. On each of the branches of the two U-profiles a respective flexible tongue 36 or 37, respectively, with a specific shape is provided, which flexible tongues 36 and 37 form segment-like resilient contact areas for contacting in sockets with a round contact opening in the folded contact plug, in correspondence with the periphery of a theoretical cylinder having a diameter of roughly 7 mm. On the other hand, when the grounding contact pin 30 is inserted into a socket with a rectangular shape (4×8 mm), these flexible tongues 36, 37 are deflected by the inclination 36 bent at their front ends, in an inward direction towards the pin axis and hence disappear inside the hollow contact pin 30 that is formed by the two nested U-profiles. The FIGS. 5 and 6 illustrate the two different potential applications of the grounding contact pin 30.

Figure 12:
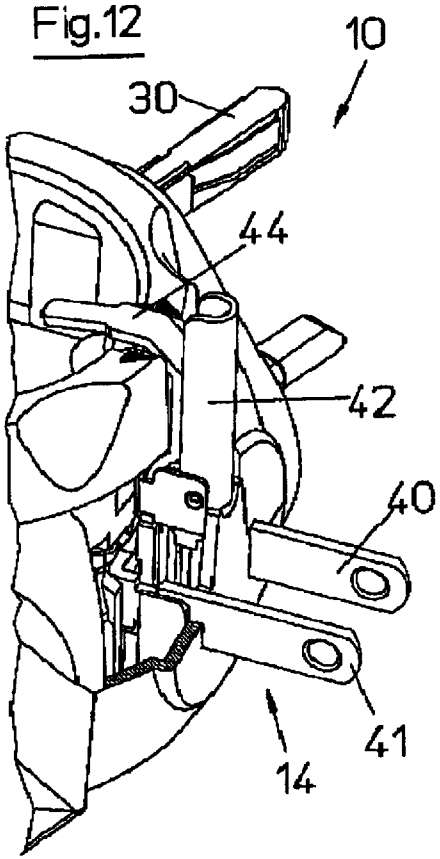
FIG. 12 is a view according to FIG. 10, in which the grounding contact pin is completely folded down and the locking lever is pivoted inwards while it prevents the insertion of a grounding contact plug into the socket receptacle.
Figure 11:
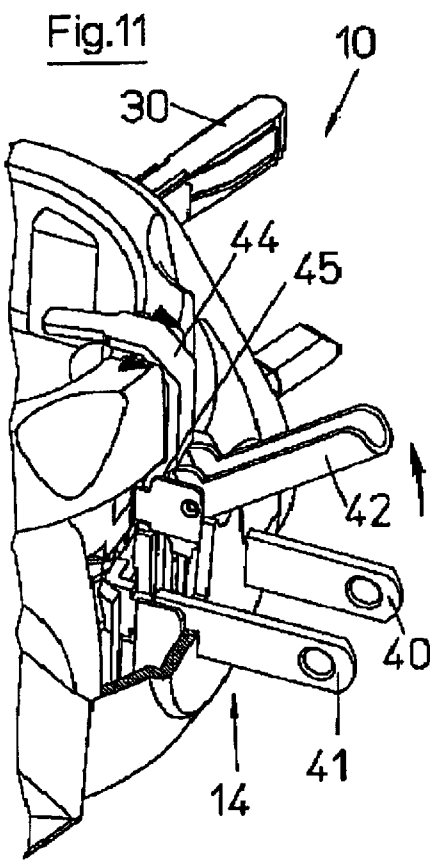
FIG. 11 illustrates a first pivoting stage of the fold-down grounding contact pin and the locking lever pivoted already completely into the socket receptacle.
Figure 10:
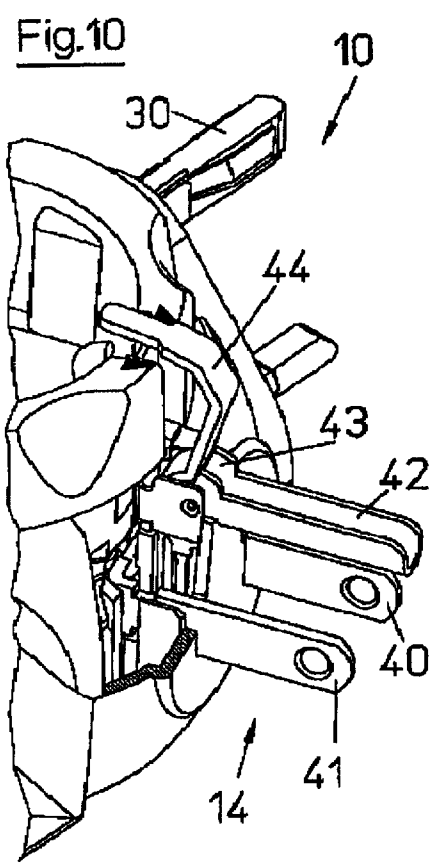
FIG. 10 is a perspective, partly cut view of a plug system combining the America plug with a fold-down grounding contact pin and including a locking lever.

FIGS. 10 to 12 illustrate a section of the electrical plug-in adapter 10 with the plugging system 14. The plugging system 14 can be converted from the position shown in FIG. 10 into an American plugging system with two fiat plugs 40 and 41; to this end, a grounding contact pin 42 of U-shaped design, which serves to form the plugging system 14 in the case of a corresponding nationally specific plugging system configuration, can be pivoted out of the position shown in FIG. 10 in an upward direction for bearing against the housing 11, with cams 43 integrally formed in the region of the pivoting point of the contact pin 42 engaging on a locking lever 44 and pivoting same out of the position shown in FIG. 10 into the locking position according to FIG. 12. As the grounding contact pin 42 and the locking lever 44 present axes of rotation in an invariable relationship with each other, a relative movement with a corresponding ratio is created by different lever arms between the two parts. Here, the tips of the cams 43 slide on the lower end of the straight central piece of the locking lever until the latter arrives in its final position in which it is inwardly pivoted into the socket receptacle 17. This point is reached already after a suitable movement of the contact pin through roughly 30°, illustrated in FIG. 11. When the pivoting movement is continued up to the final 90° position the cams 43 slide in a round recess 45 on the locking lever 44, with both parts bearing in registered position "back to back", thus assuming a stable final position, as is illustrated In FIG. 12. The outward pivoting movement of the locking lever 44 is possible only after the grounding contact pin 42 has been pivoted back into its position of use. Only then the insertion of a grounding contact plug into the socket receptacle 17 is released again or it becomes possible to continue the rotation of the socket receptacle 17 to another plug position.

The plugging system is a combination of an American plug with a fold-down grounding contact pin 42. It permits additional adaptation to two-pin sockets without grounding contact, which are still in use in some countries. In these cases of adaptation to a two-pin socket, however, the operation of electrical appliances with grounding contact plug connector, such as traveling smoothing irons, etc., is not permitted for reasons of safety. To this end, the locking fever 44 is provided that is in operative connection with the grounding contact pin 42 to be folded down and that penetrates inevitably into the socket receptacle 17 and locks the latter against insertion of a grounding contact plug when the grounding contact pin is folded up and in the locking position away from flat plugs 40 and 41, as shown in FIG. 12, for allowing plugs 40 and 41 to plug into an American plugging system, a plugging system known to those of skill in the art, without interference.

Figure 13:
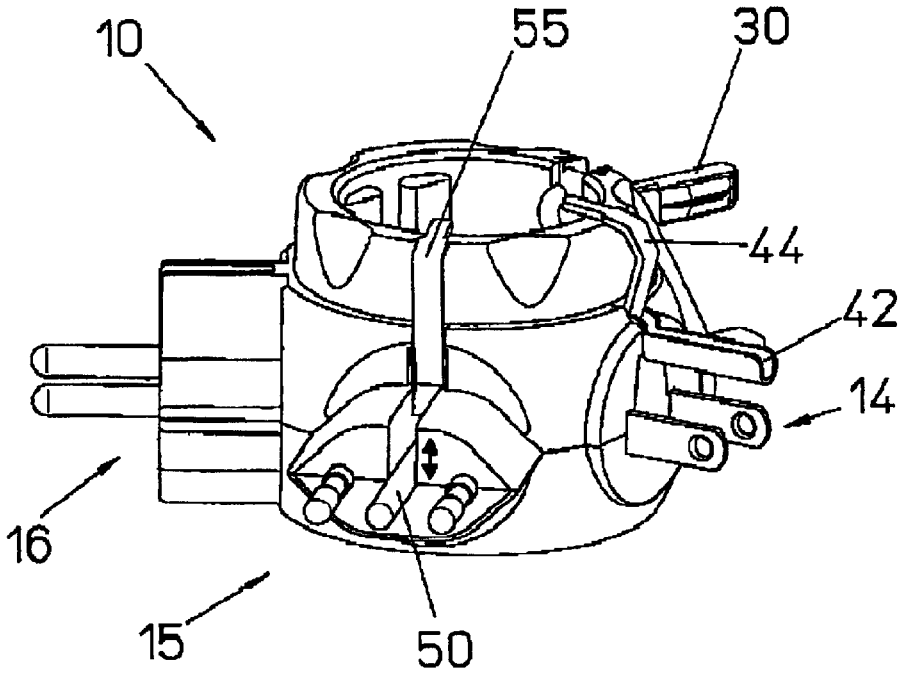
FIG. 13 is a perspective view of a plug system combining the Swiss and Italian plugging systems, with a centrally disposed grounding contact pin being designed for displacement.
Figure 14:
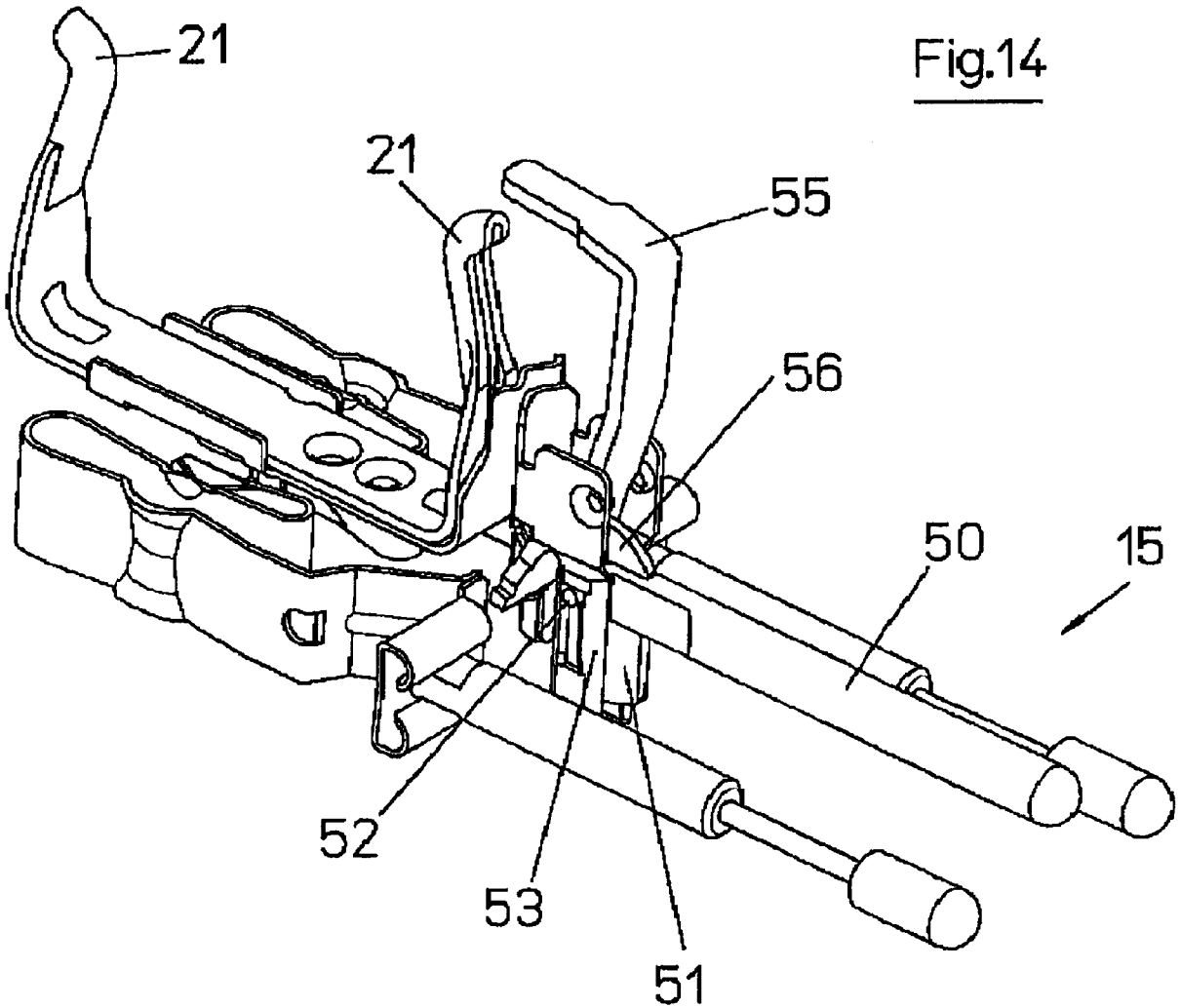
FIG. 14 shows a perspective view of the components of the plug system according to FIG. 13.
Figure 15:
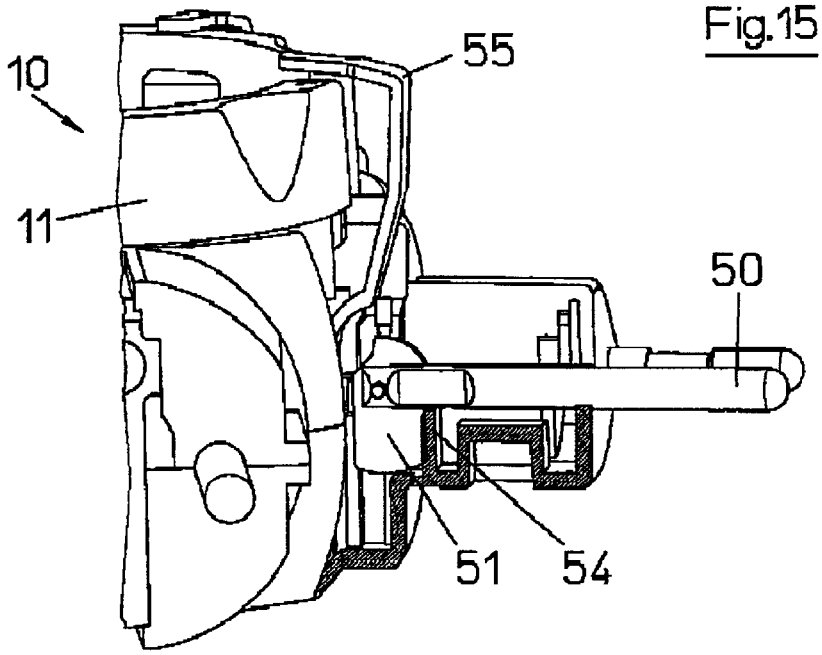
FIG. 15 is a partially cut side view of the plug system according to FIG. 13, which illustrates the grounding contact pin in its lowermost position.
Figure 16:
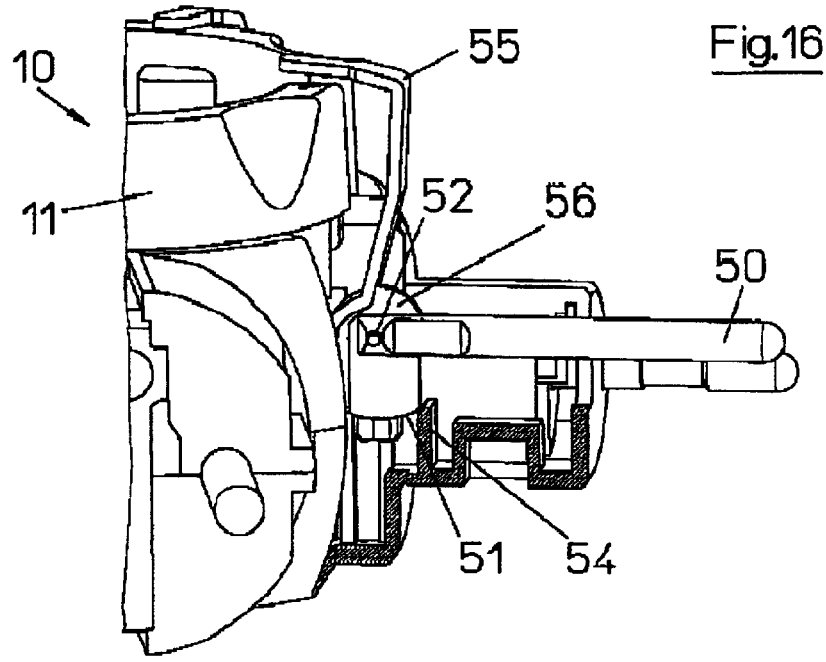
FIG. 16 shows an illustration according to FIG. 15, in which, however, the grounding contact pin is disposed in its uppermost position.
Figure 18:
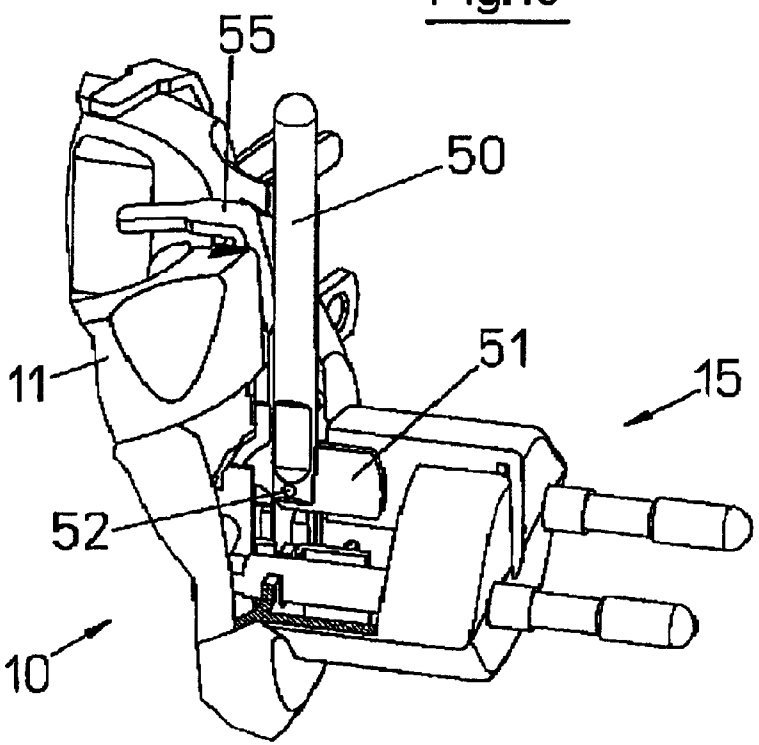
FIG. 18 is a view similar to FIG. 17, in which the grounding contact pin is completely tilted upwards and has pivoted a locking lever into the insertion region of the socket receptacle in order to prevent the insertion of a grounding contact plug.
Figure 17:
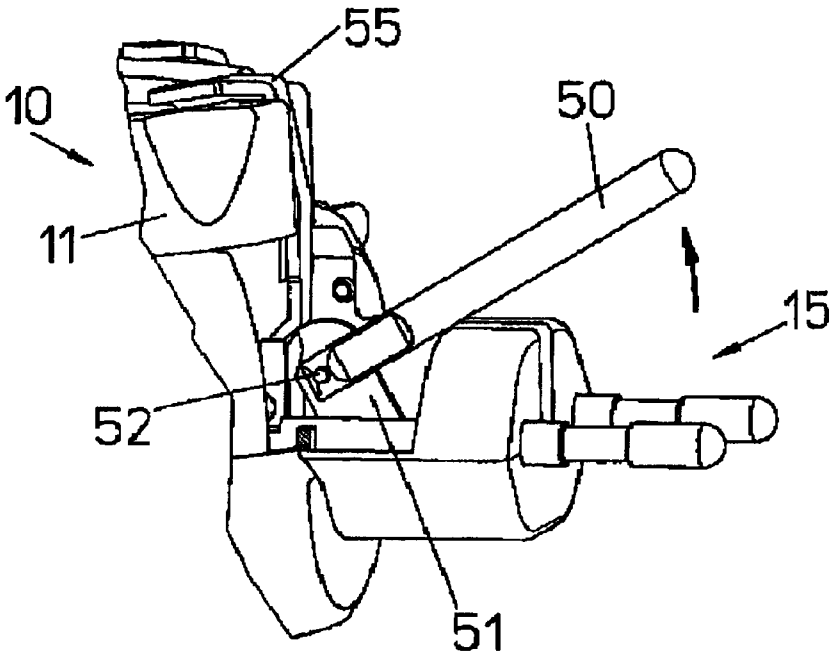
FIG. 17 is an illustration similar to that of FIG. 16, with a grounding contact pin pivoted half while the locking lever is pivoted inwards already completely.

FIG. 13 illustrates the plug-in adapter with a plugging system 15 oriented in the forward direction, wherein a centrally disposed grounding contact pin 50 is designed for vertical pivoting so as to match the plugging system 15 with different plugging situations. The FIGS. 15 to 18 illustrate the locking mechanism known from FIGS. 10 to 12 for the Italian and Swiss contact systems. As is apparent from FIGS. 14 to 16, the grounding contact pin 50 is provided with a unilateral bent guiding element 51 that comprises a lateral rotational cam 52 chat is guided in an appropriate longitudinal guide 53 in the housing. The bent guiding element 51, jointly with the rotational cam 52, serves to achieve a vertical parallel shift, with the guiding element 51 in its lower position according to FIG. 15 bearing against a guiding section 54 on the housing side and, in its upper position according to FIG. 16, being capable of pivoting upward about the rotational cam 52 from this integrally formed element, without being prevented from such movement, as is roughly indicated in FIGS. 17 and 18. The grounding contact pin 50 is hence pivotable only in the upper final position (Swiss plug) through 90° in an upward direction for operation of the locking mechanism or the locking lever 55. In the lower final position (Italian plug) the pivoting movement of the grounding contact pin 50 is not possible.

The rear end of the grounding contact pin 50 presents equally an integrally formed cam 58 that co-operates with the locking lever 55 when the grounding contact pin 50 is shifted into the upper pivoted position. The locking cam 58 and the guiding element 51 form a structure similar to a key bit on the rear end of the plug contact pin 50. When the grounding contact pin 50 is pivoted upwards the locking lever 55 is pivoted into the region of the socket receptacle 17, in a manner similar to the embodiment according to FIGS. 10 to 12, and locks the receptacle to prevent the insertion of a grounding contact plug.

Figure 19:
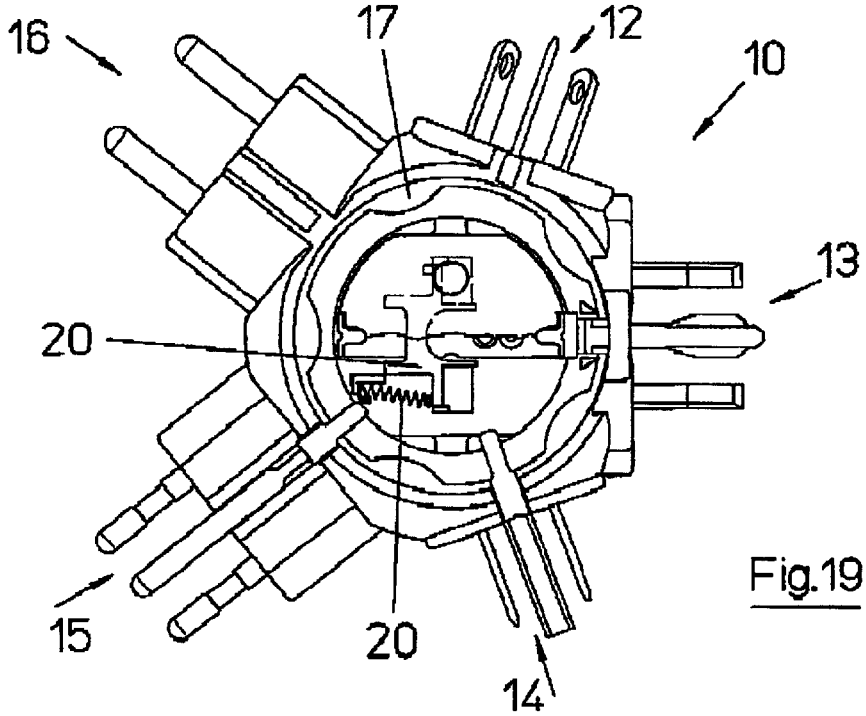
FIG. 19 is a plan view of the plug-in adapter in a slightly rotated position for illustration of a partly cutaway locking element.
Figure 20:
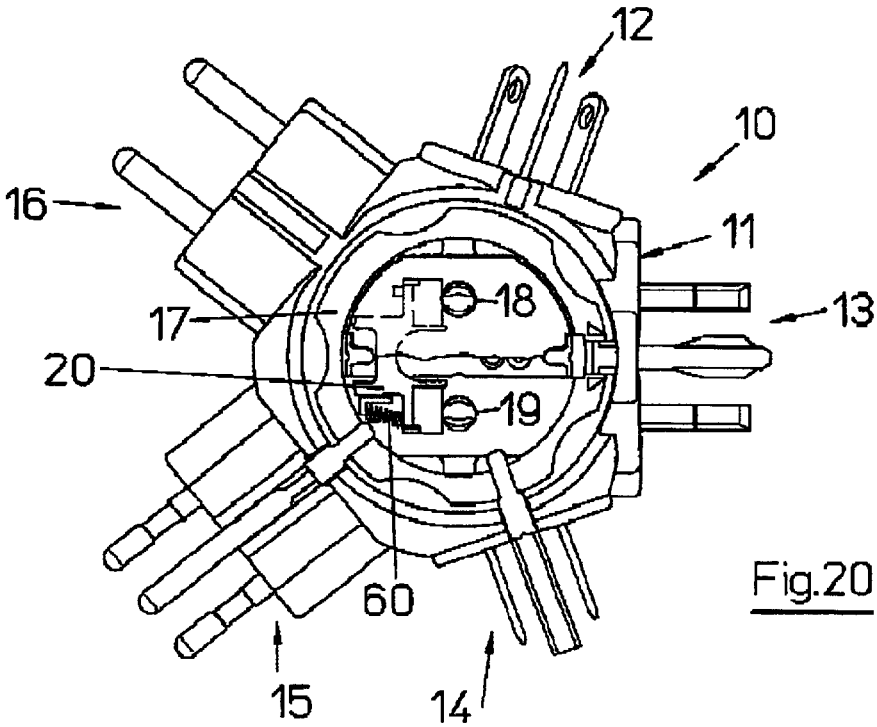
FIG. 20 shows a view similar to that of FIG. 19, in which the locking element is laterally pushed aside so as to release the plug contacts.

The FIGS. 19 and 20 illustrate the electrical plug-in adapter 10 according to FIG. 1, in which the bottom of the socket receptacle is broken away by half, for illustration of the locking means 20, which has been mentioned in relation to FIG. 1 already, in its two positions. The locking means 20 consists of a bifurcated flat slide that is pushed over the plug contact openings 18 and 19 according to FIG. 9 by means of a compression spring 60 ands that can be laterally disengaged out of this position, in accordance with FIG. 19, into the position according to FIG. 20 when plug pins of equal length are placed thereon.

Figure 21:
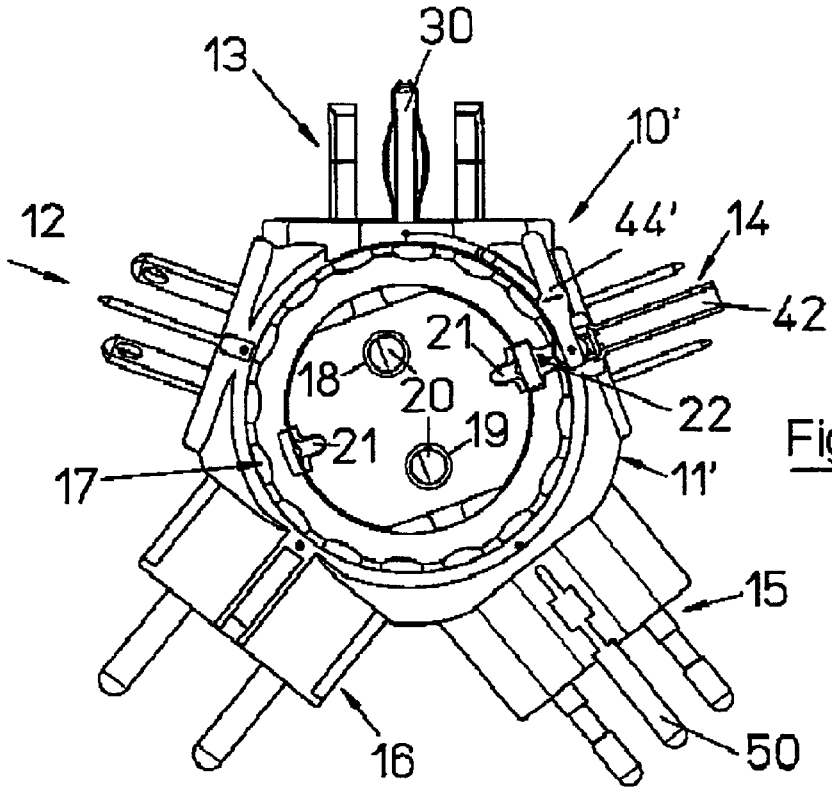
FIG. 21 is a plan view of a second embodiment of an electrical plug-in adapter according to the present invention.
Figure 22:
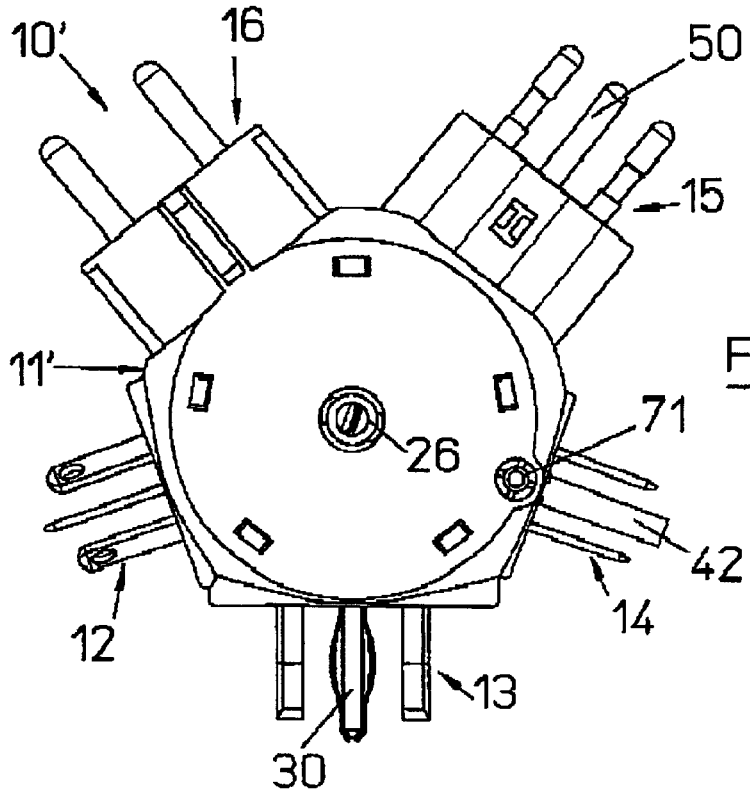
FIG. 22 shows a view from below of the plug-in adapter according to FIG. 21.
Figure 24:
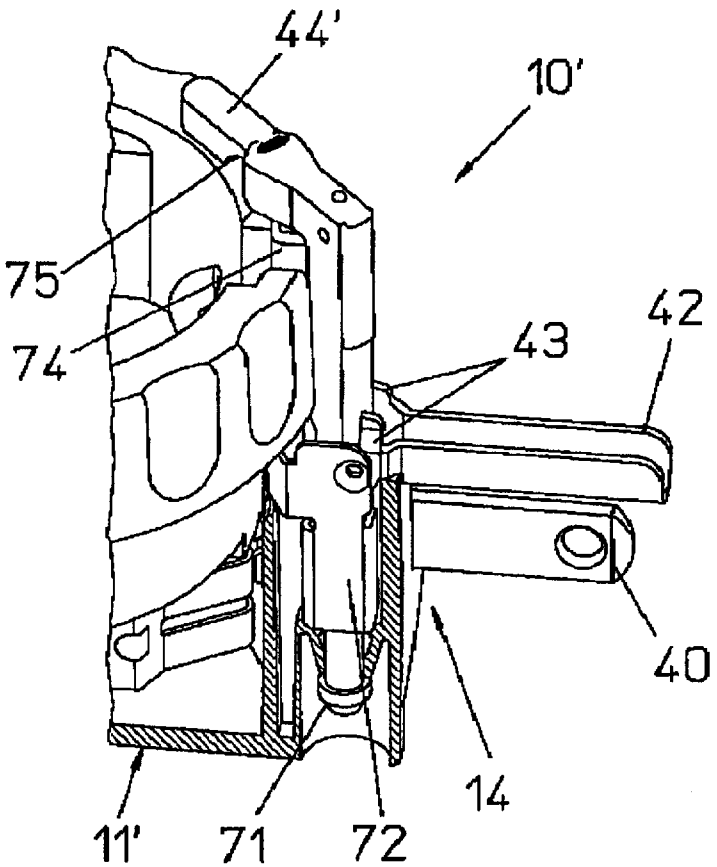
FIG. 24 is a view similar to FIG. 23, in which the locking lever is drawn upwards and is partly pivoted.
Figure 23:
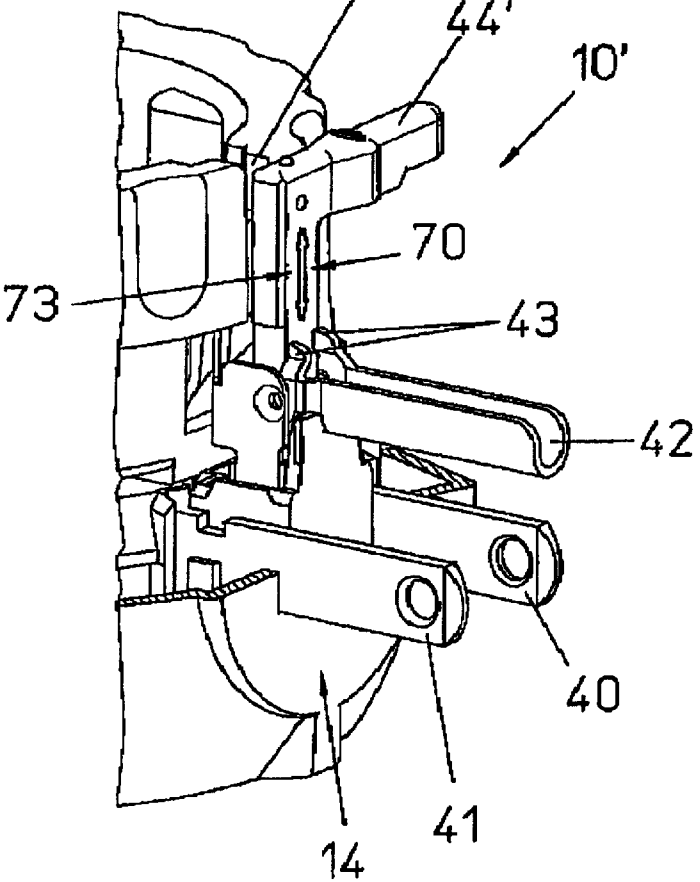
FIG. 23 is an enlarged perspective and partly cut-away view of a plugging system combining the America plug with a grounding contact pin adapted to be tilted away, and including a modified locking lever.
Figure 26:
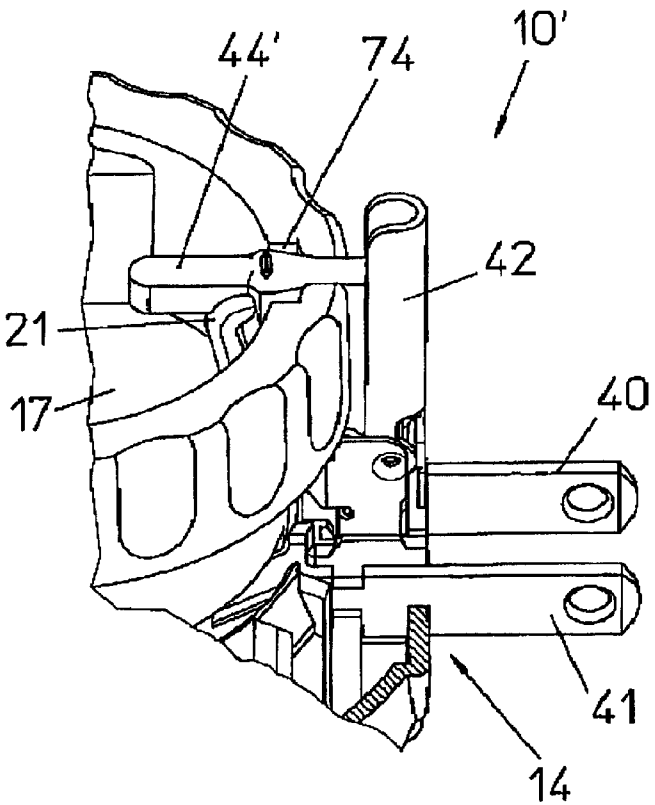
FIG. 26 is a view similar to chat according to FIG. 25, in which, however, the locking lever is inserted into a recess of the housing on the side of the edge, above the grounding contact, on the socket receptacle, whilst the grounding contact pin is pivoted upwards.
Figure 25:
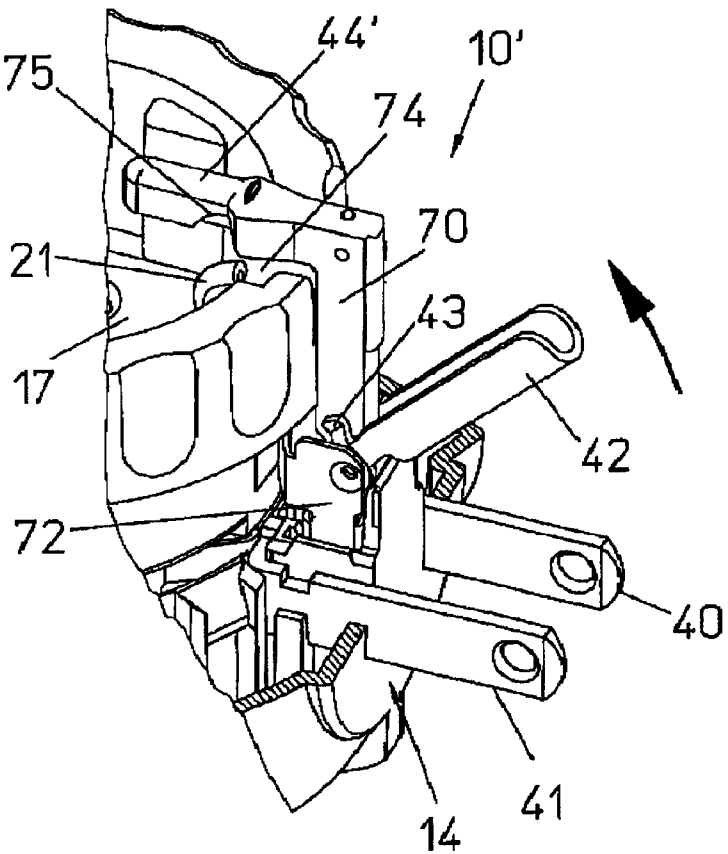
FIG. 25 shows a view similar to that of FIG. 24, in which, however, the locking lever is pivoted towards the socket receptacle.

FIGS. 21 to 30 illustrate a second embodiment of an inventive plug-in adapter 10' that is distinguished from the first embodiment mainly by the provision that only one locking lever 44' is provided that can be moved by a pushing and pivoting movement out of its inoperative position illustrated in FIG. 21 into the locking position above the grounding contact 21 of the socket receptacle 17, which position is shown in FIG. 26. For simplification, the reference numerals have been retained to identify the same components in each of the Figures. In order to avoid repetitions references is therefore made to the corresponding passages of the description of these components for the first embodiment. In its inoperative position, which is illustrated in FIG. 1, the locking lever 44' is located on the outside of the socket receptacle 17 in a position pushed downwards. The locking lever 44' is connected to a profiled pivoting shaft 70 that is held in a round pin holder 21 in the housing 11' of the plug-in adapter 10', which is shown in a view from below in FIG. 22 and in a perspective partly sectioned view in FIG. 24. The pivoting shaft is moreover guided in a housing section 72 that is shaped from a punched sheet metal material and supported for pivoting movement on the grounding contact pin. The grounding contact pin 42 comprises integrally formed cams 43 that bear against a lateral stopping profile 73 of the pivoting shaft 70 when the locking lever 44 is in its inoperative position, thus locking the grounding contact pin 42 to prevent it from pivoting upwards. When the locking lever 44, which is optionally made of synthetic resin or zinc diecasting, is drawn upwards out of its inoperative position, as is illustrated in FIG. 23, the stopping profile 73 moves out of the bearing zone of the cams 43 and the pivoting movement of the locking lever 44' inwards according to FIGS. 25 and 26, the pin 42 can then be pivoted upwards, with the cams 43 creating the additional effect that they surround the pivoting shaft 70, thus locking the grounding contact ping 42 in its vertical pivoting position. It is moreover apparent from FIG. 26 that the locking lever 44' is inserted into the housing recess 74 on the side of the edge above the grounding contact 21, with the upper end of the grounding contact 21 being received in a recess 75 formed on the underside of the locking lever 44'. With this provision, an additional reinforcement of the support for the locking lever 44' is expediently achieved. 21 into the locking position above the grounding contact 21 of the socket receptacle 17, which position is shown in FIG. 26. For simplification, the reference numerals have been retained to identify equal components. In order to avoid repetitions, reference is therefore made to the corresponding passages of the description of these components for the first embodiment. In its inoperative position, which is illustrated in FIG. 1, the locking lever 44' is located on the outside of the socket receptacle 17 in a position pushed downwards. The locking lever 44 is connected to a profiled pivoting shaft 70 that is held in a round pin holder 21 in the housing 11' of the plug-in adapter 10', which is shown in a view from below in FIG. 22 and in a perspective partly sectioned view in FIG. 24. The pivoting shaft 70 is moreover guided in a housing section 72 that is shaped from a punched sheet metal material and supported for pivoting movement on the grounding contact pin. The grounding contact pin 42 comprises integrally formed cams 43 that bear against a lateral stopping profile 73 of the pivoting shaft 70 when the locking lever 44 is in its inoperative position, thus locking the grounding contact pin 42 to prevent it from pivoting upwards. When the locking lever 44, which is optionally made of synthetic resin or zinc diecasting, is drawn upwards out of its inoperative position, as is illustrated in FIG. 23, the stopping profile 73 moves out of the bearing zone of the cams 43 and after the pivoting movement of the locking lever 44' inwards according to FIGS. 25 and 26, the pin 42 can then be pivoted upwards, with the cams 43 creating the additional effect that they surround the pivoting shaft 70, thus locking the grounding contact pin 42 in its vertical pivoting position. It is moreover Apparent from FIG. 26 that the locking lever 44' is inserted into the housing recess 74 on the side of the edge above the grounding contact 21, with the upper end of the grounding contact 21 being received in a recess 75 formed on the underside of the locking lever 74'. With this provision, an additional reinforcement of the support for the looking lever 44 is expediently achieved.

Figure 27:
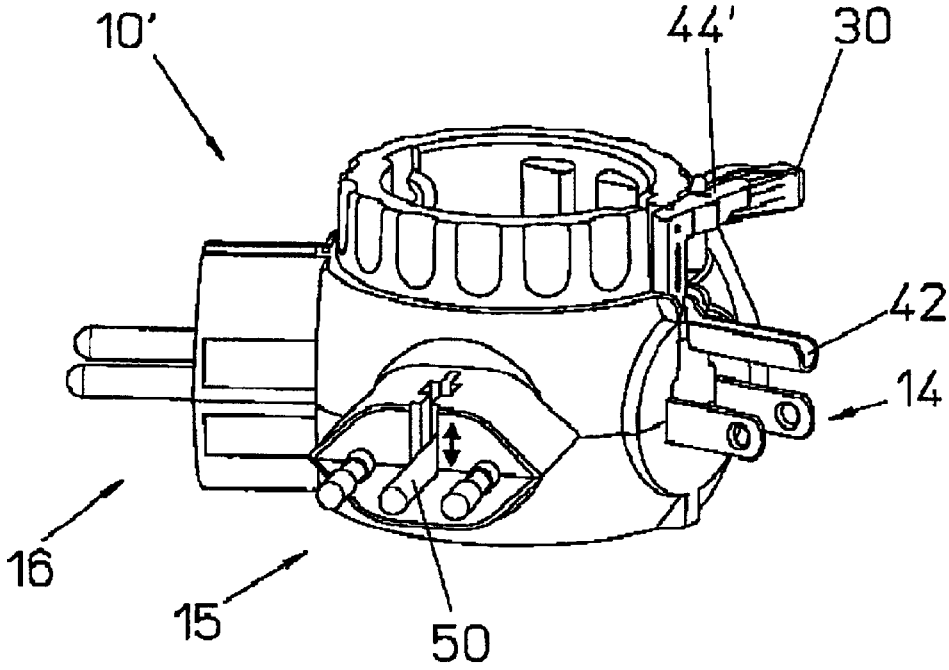
FIG. 27 is a perspective view of the plug-in adapter according to the second embodiment for illustrating the modified Swiss and Italian plugging systems.

FIG. 27 shows a perspective view of the second embodiment of the plug-in adapter 10', similar to the view in FIG. 13, in which the plugging system 15 is modified for Switzerland and Italy to the effect that the grounding contact pin 50 can still be displaced in a vertical direction only and can no longer be pivoted, as has been described above with reference to FIGS. 14 to 18 for the first embodiment. Moreover, the locking lever 55 of the first embodiment has been omitted here, too. The plugging system 15 accordingly still permits only the connection to grounding contact sockets, with the grounding contact pin 50 being adapted for vertical insertion in two positions.

Figure 28:
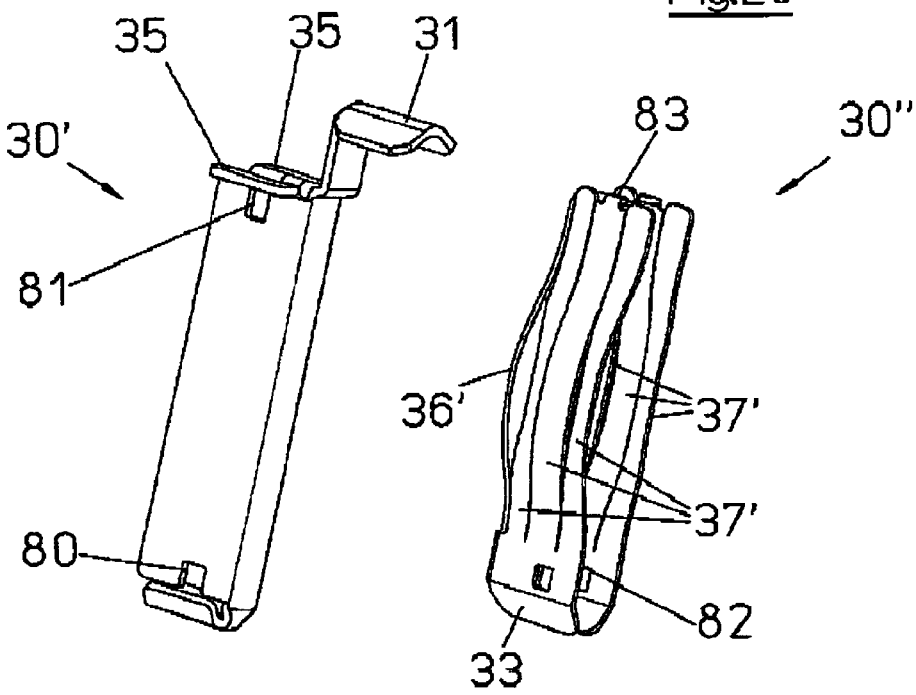
FIG. 28 shows an enlarged perspective illustration of the two components of the grounding contact pin for the old British and the new British plugging systems.
Figure 29:
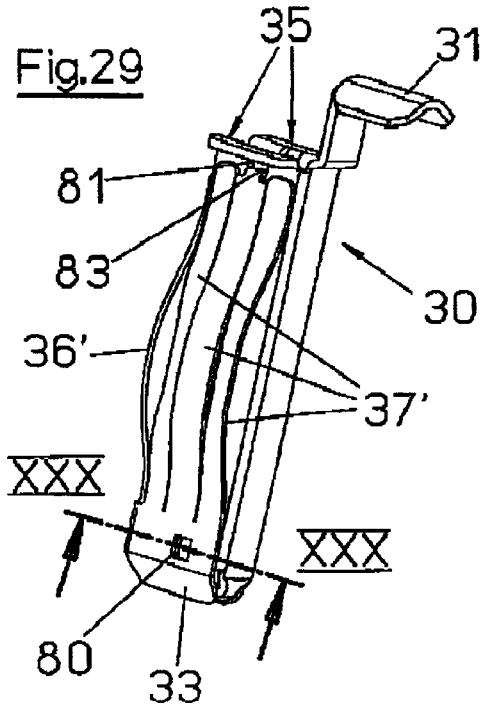
FIG. 29 is a perspective view of the grounding contact pin of FIG. 28 in the assembled condition.
Figure 30:
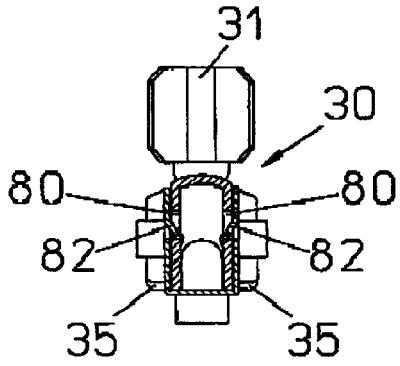
FIG. 30 illustrates a sectional view along the sectional line XXX—XXX in FIG. 29.

The FIGS. 28 to 30 serve to explain the second embodiment in more details by the enlarged views of the bipartite structure of the grounding contact pin 30. In variation from the integral one-piece structure of the grounding contact pin 30, which is shown in FIGS. 7 to 9, here the grounding contact pin 30 consists of a hollow contact pin body 30' that is shaped from a punched sheet metal material and presents catching openings 80 and 81 on both sides, which are provided for the bent tongues 82 to 83 for fastening a resilient element 30". The resilient element 30" is provided with opposing resilient tongues 37' as well as a resilient tongue 36' on the rear side while it can be caught on the hollow contact pin body 30'. In all other respects, reference is made to the description of the first embodiment.

What is claimed is:

1. A plug-in adapter for optional connection of a three-pin plug system to different nationally specific plugging systems with and without grounding contact, comprising:

(a) a housing, several different permanently-projecting plugging systems being disposed on the outside periphery thereof; and (b) a socket receptacle supported for rotation in said housing and having electrical contacts adapted to be connected to corresponding electrical contacts of one of said plugging systems according to a respective rotational position of the socket receptacle, wherein at least one of the plugging systems comprises a grounding contact pin supported for movement in the housing, the grounding contact pin in one system for connection to both an old British system with round plug pins and to a new British system with rectangular pins comprising a peripheral area with rounded and resilient sections disposed opposite each other, respectively, and at least one bent guiding section which is guided for displacement between two spaced stops in said housing.

2. The plug-in adapter according to claim 1, wherein said contact pin is shaped from a punched folded brass sheet material with a hollow interior space.

3. The plug-in adapter according to claim 1, wherein said resilient sections are formed with flexible tongues adapted to be moved from a laterally projecting position for insertion of the contact pin into a round contact opening to a position inside a hollow interior space for insertion into a rectangular contact opening.

4. The plug-in adapter according to claim 1, wherein a plug system with a solid displaceable grounding contact pin is provided for the connection to the Swiss and Italian plugging systems.

5. The plug-in adapter according to claim 4, wherein said grounding contact pin presents a guiding profile on its rear end and is adapted for being pivoted via lateral pins in said housing in a direction orthogonal on the remaining contact pins of the plug-in system.

6. The plug-in adapter according to claim 5, wherein said guiding profile is locked by a housing stop so as to be prevented from pivoting beyond the uppermost displacement position in said housing.

7. The plug-in adapter according to claim 4, further including a locking lever that engages into said socket receptacle in its locking position, wherein the grounding pin is in an upright position, which can be activated and secured by means of said grounding contact pin.

8. The plug-in adapter according to claim 1, wherein a locking mechanism is provided for plug-in openings of said socket receptacle.

9. The plug-in adapter according to claim 2, wherein said contact pin comprises a hollow contact pin body on which a resilient element is fastened for catching engagement, which presents resilient tongues.

10. The plug-in adapter according to claim 1, wherein a locking lever is provided that engages into said socket receptacle in its locking position, wherein the grounding pin is in an upright position, and that is disposed, in its inoperative position, outside said socket receptacle.

11. The plug-in adapter according to claim 10, wherein said locking lever is adapted to be moved by a pushing and pivoting movement out of its inoperative position into its locking position.

12. The plug-in adapter according to claim 10, wherein said grounding pin is locked and prevented from pivoting by said locking lever in its inoperative position.

13. The plug-in adapter according to claim 12, wherein said grounding contact pin comprises contact pin cams, and wherein said locking lever comprises a profiled pivoting shaft that is supported in said housing and is provided with a stopping profile for said contact pin cams in the inoperative position.

14. The plug-in adapter according to claim 10, wherein said locking lever is adapted to be inserted in a housing recess on the side of the edge above said grounding contact on said socket receptacle.

* * * * *